US012221888B2

(12) United States Patent
Feng et al.

(10) Patent No.: US 12,221,888 B2
(45) Date of Patent: Feb. 11, 2025

(54) VENTILATION METHOD FOR HIGH GAS WORKING FACE BASED ON ALTERNATING INTAKE AND AIR RETURN IN MINE GALLERY

(71) Applicant: Taiyuan University of Technology, Taiyuan (CN)

(72) Inventors: Guorui Feng, Taiyuan (CN); Zhu Li, Taiyuan (CN); Jianyu Fan, Taiyuan (CN); Jingyu Zhang, Taiyuan (CN); Chengen Qi, Taiyuan (CN); Guilin Wu, Taiyuan (CN)

(73) Assignee: Taiyuan University of Technology, Taiyuan (CN)

( * ) Notice: Subject to any disclaimer, the term of this patent is extended or adjusted under 35 U.S.C. 154(b) by 0 days.

(21) Appl. No.: 18/885,086

(22) Filed: Sep. 13, 2024

(65) Prior Publication Data

US 2025/0003337 A1 Jan. 2, 2025

(30) Foreign Application Priority Data

Sep. 25, 2023 (CN) ..... 202311234521.9

(51) Int. Cl.
*E21F 1/18* (2006.01)
*E21D 23/04* (2006.01)
*E21F 1/10* (2006.01)

(52) U.S. Cl.
CPC ..... *E21F 1/18* (2013.01); *E21F 1/10* (2013.01); *E21D 23/04* (2013.01)

(58) Field of Classification Search
CPC ..... E21F 1/10; E21F 1/18; E21D 23/04
(Continued)

(56) References Cited

U.S. PATENT DOCUMENTS 4,398,451 A 8/1983 Werthmann
2023/0175398 A1* 6/2023 Wang ..... E21F 1/00 454/168

FOREIGN PATENT DOCUMENTS

AU 2018200880 A1 8/2018
CN 1664310 A 9/2005
(Continued)

OTHER PUBLICATIONS

Guorui Feng, "Study on the Theory and Its Application of Upward Mining of Left-Over Coal", Chinese excellent doctoral dissertation full text database Engineering Science and Technology I series, Jan. 15, 2011, pp. 1-212.

(Continued)

*Primary Examiner* — Allen R. B. Schult

(57) ABSTRACT

A ventilation method for a high gas working face based on alternating intake and air return in a mine gallery is provided. In this method, an isolated island working face is divided into several sections along a strike direction. A coal pillar is alternately set as a conventional section and a gas-drainage section. Opposite coal pillars in the two mine galleries within the same section are respectively used as the conventional section and the gas-drainage section. Two mine galleries on both sides of the isolated island working face are alternately used as an intake gallery and a return gallery. The coal pillar at the side of the mine gallery as the return gallery is the gas-drainage section. A gas-drainage hole communicating a goaf is provided in the gas-drainage section, so that gas in the goafs at two sides of the isolated island working face can be extracted alternately.

7 Claims, 2 Drawing Sheets

(58) Field of Classification Search
USPC ..... 454/168
See application file for complete search history.

(56) References Cited

FOREIGN PATENT DOCUMENTS

| | | | |
|---|---|---|---|
| CN | 101033689 | A | 9/2007 |
| CN | 101251028 | A | 8/2008 |
| CN | 201723246 | U | 1/2011 |
| CN | 102287212 | A | 12/2011 |
| CN | 102337904 | A | 2/2012 |
| CN | 102562088 | A | 7/2012 |
| CN | 105221179 | A | 1/2016 |
| CN | 105422099 | A | 3/2016 |
| CN | 105525903 | A | 4/2016 |
| CN | 106285692 | A | 1/2017 |
| CN | 107956509 | A | 4/2018 |
| CN | 109252884 | A | 1/2019 |
| CN | 109882172 | A | 6/2019 |
| CN | 109915198 | A | 6/2019 |
| CN | 110295903 | A | 10/2019 |
| CN | 111622795 | A | 9/2020 |
| CN | 111927455 | A | 11/2020 |
| CN | 114961728 | A | 8/2022 |
| FR | 382208 | A | 2/1908 |
| RU | 2787763 | C1 | 1/2023 |
| WO | 0008305 | A1 | 2/2000 |
| WO | 2016206618 | A1 | 12/2016 |
| WO | 2021219130 | A1 | 11/2021 |

OTHER PUBLICATIONS

Xue Yang, "The Ventilation Air Methane Technology Research in Fully Mechanized Caving Face of Dahuangshan Mine", Chinese excellent master's dissertation full text database Engineering Science and Technology I series, Mar. 15, 2015, pp. 1-89.

Xiaohui Zhu, "Applicability and Gas Control of Ventilation Methods in High Gas Working Face", Shanxi Coal, vol. 38, No. 5, Oct. 31, 2018, pp. 43-46.

* cited by examiner

VENTILATION METHOD FOR HIGH GAS WORKING FACE BASED ON ALTERNATING INTAKE AND AIR RETURN IN MINE GALLERY

CROSS-REFERENCE TO RELATED APPLICATIONS

This application claims the benefit of priority from Chinese Patent Application No. 202311234521.9, filed on Sep. 25, 2023. The content of the aforementioned application, including any intervening amendments thereto, is incorporated herein by reference in its entirety.

TECHNICAL FIELD

This application relates to gas control of coal mines, and more particularly to a ventilation method for a high gas working face based on alternating intake and air return in a mine gallery.

BACKGROUND

Coal seam gas is a flammable gas adsorbed in coal seams and generated from ancient plants and other humic organic materials buried underground through crustal movement under the action of geothermal heat and anaerobic bacteria, and is formed simultaneously with coal. The coal seam gas mainly includes alkane, which is predominated by methane, and is flammable and explosive. For the gas-containing coal seams, internal drilling is often performed before mining for pre-cracking, and then the gas is extracted from the seams. However, due to influence of the formation pressure and the degree of pre-cracking of the coal seams, there is still a certain amount of gas remaining in the coal seams during mining, which will result in the presence of a large amount of gas in the goaf after the coal seams have been mined.

The mine ventilation can supply fresh air to the underground to meet the oxygen demand of miners and discharge the gas generated during the coal seam mining, but the gas in the goaf cannot be discharged by mine ventilation. As shown in FIG. 1, both sides of the isolated island working face 4 formed in the mining production process are the goafs 6, in which a large amount of residual gas is present. In the mining process of the island working face, when arranging the mine galleries 1-2, a certain width of coal pillar will be left between the mine gallery and the goaf 6. In the case of insufficient width, transverse fissures will occur within the coal pillar, and communicate the mine gallery with the goaf. As a result, the gas in the goaf will enter the mine gallery and affect the normal mine ventilation and production. The excessive width will cause the loss of coal resources. The surface drilling to the goaf for gas extraction will lead to large construction and equipment costs. Moreover, the gas extraction in the goaf will still affect the normal ventilation of the island working face. In addition, due to the saddle-shaped distribution and the low density of gas, the gas content in the area of the goaf near the mine gallery on both sides of the island working face is high, which is more unfavorable to the stoping and ventilation of the island working face.

SUMMARY

For ventilation problem caused by gas in an adjacent goaf in an isolated island working face, in this application, the isolated island working face is divided into several sections.

A coal pillar is alternately divided into a conventional section and a gas-drainage section, and the coal pillars in two mine galleries within the same section are the conventional section and the gas-drainage section respectively. A gas-drainage hole is provided in the gas-drainage section for connecting the mine gallery to the goaf, and the mine galleries on both sides are alternately used as the air intake and air return galleries, and the gas-drainage holes are used to extract the gas from the goaf on both sides alternately.

This application provides a ventilation method for a high gas working face based on alternating intake and air return in a mine gallery, comprising:

(a) tunnelling a first mine gallery at a dip-direction lower side of an isolated island working face along a strike direction; leaving a first coal pillar between the isolated island working face and a first goaf; and reinforcing the first coal pillar by grouting and concrete pouring; and tunnelling a second mine gallery at a dip-direction upper side of the isolated island working face along the strike direction; leaving a second coal pillar between the isolated island working face and a second goaf; and reinforcing the second coal pillar by grouting and concrete pouring;

(b) making an open-off cut to communicate the first mine gallery with the second mine gallery; and deploying a coal mining device in the open-off cut;

(c) dividing the isolated island working face into N sections from the open-off cut along the strike direction, wherein the N sections are sequentially numbered as 1, 2, . . . , and N; dividing the first coal pillar into a plurality of first conventional sections and a plurality of first gas-drainage sections; and dividing the second coal pillar into a plurality of second gas-drainage sections and a plurality of second conventional sections; wherein the plurality of first conventional sections and the plurality of first gas-drainage sections are alternately arranged; the plurality of second conventional sections and the plurality of second gas-drainage sections are alternately arranged; the plurality of first conventional sections are respectively opposite to the plurality of second gas-drainage sections; and the plurality of first gas-drainage sections are respectively opposite to the plurality of second conventional sections;

(d) within a section 1 among the N sections, drilling a first gas-drainage hole in a gas-drainage section of the second mine gallery, wherein the first gas-drainage hole is communicated with the second goaf; and performing stoping at the section 1; and feeding a first fresh air into a coal mining area through the first mine gallery to form a first ventilation air methane (VAM) which is discharged through the second mine gallery;

(e) within a section 2 among the N sections, drilling a second gas-drainage hole in a gas-drainage section of the first mine gallery, wherein the second gas-drainage hole is communicated with the first goaf; and performing stoping at the section 2; and feeding a second fresh air into the coal mining area through the second mine gallery to form a second VAM which is discharged through the first mine gallery; and (f) sequentially carrying out stoping and alternating intake and air return on sections 3-N among the N sections, wherein the stoping and the alternating intake and air return for odd-numbered sections are performed according to step (d); and the stoping and the alternating intake and air return for even-numbered sections are performed according to step (e).

In an embodiment, in step (a), the first mine gallery is communicated with a first uphill roadway; and the second mine gallery is communicated with a second uphill roadway.

In an embodiment, in step (a), at a lower side of the first mine gallery, a first air door is provided on the first uphill roadway, and a second air door is provided on the second uphill roadway; and at an upper side of the second mine gallery, a third air door is provided on the first uphill roadway, and a fourth air door is provided on the second uphill roadway.

In an embodiment, in step (d), the first air door and the fourth air door are opened, and the third air door and the second air door are closed.

In an embodiment, in step (e), the third air door and the second air door are opened, and the first air door and the fourth air door are closed.

In an embodiment, in step (d), the first gas-drainage hole is drilled in two rows, and two rows of first gas-drainage holes are located at an upper part of the second mine gallery; and in step (e), the second gas-drainage hole is drilled in two rows, and two rows of second gas-drainage holes are located at an upper part of the first mine gallery.

This application has the following beneficial effects.

An isolated island working face is divided into several sections along a strike direction. According to the sections, a coal pillar is alternately set as a conventional section and a gas-drainage section. Opposite coal pillars in the two mine galleries within the same section are respectively used as the conventional section and the gas-drainage section. The two mine galleries on both sides of the isolated island working face are alternately used as an intake gallery and a return gallery. The coal pillars at the side of the mine gallery that serves as the return gallery is the gas-drainage section. The gas-drainage hole communicating a goaf is provided in the gas-drainage section connected to the goaf, so that the gas in the goafs at two sides of the isolated island working face can be extracted alternately. This application changes the prevention of gas in the goaf from entering the mine gallery as active management of the gas, which can solve the problem of the gas from the source. The gas can be further recovered and used for power generation, which greatly improves the production environment and enhances the utilization rate of the resources.

1—first mine gallery; 2—second mine gallery; 3—open-off cut; 4—isolated island working face; 5—coal pillar; 5*a*—conventional section; 5*b*—gas-drainage section; 5*c*—gas-drainage hole; 6—goaf; 7—stop-mining line; 8—first uphill roadway; 9—second uphill roadway; 8*a*—first air door; 8*b*—third air door; 9*a*—second air door; and 9*b*—fourth air door.

DETAILED DESCRIPTION OF EMBODIMENTS

Technical solutions of the present disclosure will be described in detail in conjunction with FIGS. 1-2.

The working conditions in this embodiment are specifically described as follows. In the early stage of mine mining, according to the coal quality and economic benefits, the exploitation succession of working faces in the mining area of this mine has been planned, and this mine has completed the production. At present, there is only one isolated island working face 4 left in the mining area. The goafs 6 are located on both dip-direction sides of the isolated island working face 4. The isolated island working face 4 has a dip width of 150 m, a strike length of 552 m, and a mining height of 4.8-5.2 m, with an average mining height of 5 m. Due to the saddle-shaped characteristics and the low gas density of the goafs 6, the gas content in the goaf 6 near the mine galleries on two dip-direction sides of the isolated island working face 4 is high, which is not conducive to the recovery and ventilation of the isolated island working face 4. For example, the gas in the goaf 6 is easy to enter the mine gallery used for air intake from the cracks of the coal pillar, which makes the concentration of the gas in the fresh air in the mine gallery used for air intake is high. The above cracks can be residual cracks due to insufficient support after tunnelling into the mine gallery, or be the cracks generated by the plastic damage or instability of the coal pillars due to the pressure of over-supporting in the production process of the working face. Before the fresh air enters the coal mining area of the working face, the fresh air has already become ventilation air methane (VAM), which threatens the safety of the workers in the coal mining area and cannot meet the workers' demand for oxygen.

Figure 1:
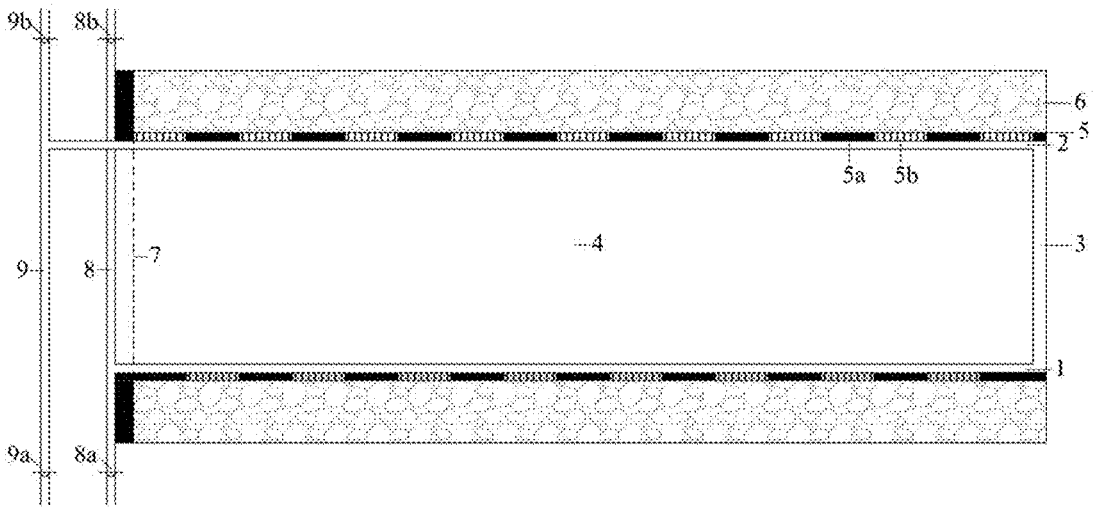
FIG. 1 schematically shows working face arrangement in a ventilation method for a high gas working face based on alternating intake and air return in a mine gallery according to an embodiment of the disclosure.
Figure 2:
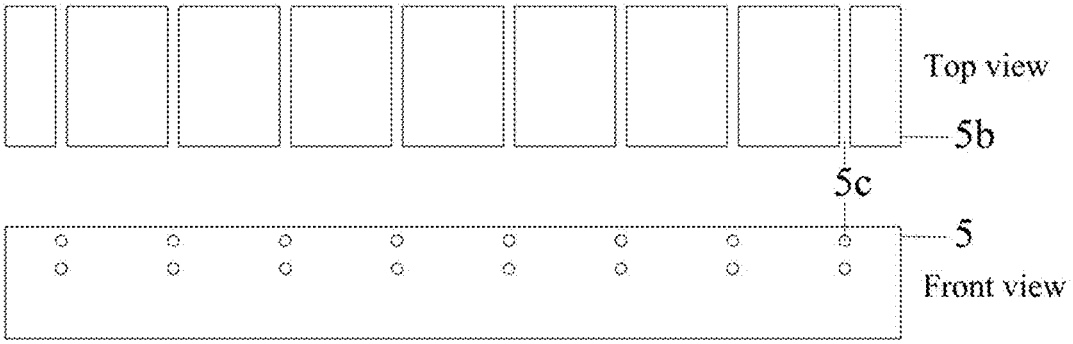
FIG. 2 is a schematic diagram of a gas-drainage section of a coal pillar according to an embodiment of the disclosure.

Referring to FIGS. 1-2, this disclosure provides a ventilation method for a high gas working face based on alternating intake and air return in a mine gallery, including the following steps.

Step 1

From the first uphill roadway 8 along the strike direction, the first mine gallery 1 with the width of 5 m and the height of 5 m is tunneled at a dip-direction lower side of the isolated island working face 4. A coal pillar 5 with the width of 5 m is left between the first mine gallery 1 and the goaf 6. The coal pillar 5 is reinforced by grouting. The concrete with the thickness of 40 cm is poured on the coal wall of the coal pillar 5 in the first mine gallery 1.

From the second uphill roadway 9 along the strike direction, the second mine gallery 2 with the width of 5 m and the height of 5 m is tunneled at a dip-direction upper side of the isolated island working face 4. A coal pillar 5 with the width of 5 m is left between the second mine gallery 2 and the goaf 6. The coal pillar 5 is reinforced by grouting. Moreover, the concrete with the thickness of 40 cm is poured on the coal wall of the coal pillar 5 in the second mine gallery 2.

In a dip-direction lower side of the first mine gallery 1, a first air door 8*a* is provided on the first uphill roadway 8, and a second air door 9*a* is provided on the second uphill roadway 9. In a dip-direction upper side of the second mine gallery 2, a third air door 8*b* is provided on the first uphill roadway 8, and a fourth air door 9*b* is provided on the second uphill roadway 9.

Step 2

An open-off cut 3 is made to communicate the first mine gallery 1 with the second mine gallery 2. The width of the open-off cut 3 is 8 m, and the height of the open-off cut 3 is 5 m. The area enclosed by the first mine gallery 1, the second mine gallery 2, the open-off cut 3 and the stop-mining line 7 constitutes the area to be stoped in the isolated island working face 4.

A coal mining device is arranged in the open-off cut 3 to make preparation for the stoping of the to be stoped area.

Step 3

The isolated island working face 4 is divided into 17 sections from the open-off cut 3 to the stop-mining line 7. The 17 sections are sequentially numbered as sections 1-17, and the width of each section is 32 m. The coal pillars 5 in the dip-direction lower side are divided into a plurality of conventional sections 5*a* and a plurality of gas-drainage sections 5*b* in order, and so on. The coal pillars 5 in the dip-direction upper side are divided into a plurality of gas-drainage sections 5*b* and a plurality of conventional sections 5*a*. The plurality of conventional sections 5*a* and the plurality of gas-drainage sections 5*b* in the dip-direction lower side are alternately arranged. The plurality of conventional sections 5*a* and the plurality of gas-drainage sections 5*b* in the dip-direction upper side are alternately arranged. The plurality of conventional sections 5*a* in the dip-direction lower side are respectively opposite to the plurality of gas-drainage sections 5*b* in the dip-direction upper side. The plurality of gas-drainage sections 5*b* in the dip-direction lower side are respectively opposite to the plurality of the conventional sections 5*a* in the dip-direction upper side.

Step 4

Within the section 1 among the 17 sections, the gas-drainage holes 5*c* in the gas-drainage section 5*b* of the second mine gallery 2 are drilled to connect the goaf 6 to the second mine gallery 2. Two rows of the gas-drainage holes 5*c* are provided and all located at the upper part of the second mine gallery 2. The horizontal spacing between the gas-drainage holes 5*c* is 4 m.

The first air door 8*a* and the fourth air door 9*b* are opened, and the third air door 8*b* and the second air door 9*a* are closed. The stoping of the coal body in the section 1 is performed. The fresh air passes through the first uphill roadway 8 and the first mine gallery 1 in turn into the coal mining area, thereby forming a ventilation air methane. Then, the ventilation air methane passes through the second mine gallery 2 and the second uphill roadway 9 in turn to discharge. When the ventilation air methane passes through the gas-drainage section 5*b*, the ventilation air methane will pump out the gas in the goaf 6 near the second mine gallery 2 from the gas-drainage holes 5*c*, thereby preventing the gas from accumulating in the side of the goaf 6 near the second mine gallery 2.

Step 5

Within the section 2, the gas-drainage holes 5*c* in the gas-drainage section 5*b* of the first mine gallery 1 are drilled to communicate the goaf 6 with the first mine gallery 1. Two rows of gas-drainage holes 5*c* are provided and all located at the upper part of the first mine gallery 1. The horizontal spacing between the gas-drainage holes 5*c* is 4 m.

The third air door 8*b* and the second air door 9*a* are opened, and the first air door 8*a* and the fourth air door 9*b* are closed. The stoping of the coal body in the section 2 is performed. The fresh wind passes through the second uphill roadway 9 and the second mine alley 2 in turn into the coal mining area, thereby forming ventilation air methane. Then, the ventilation air methane passes through the first mine alley 1 and the first uphill roadway 8 in turn to discharge. When the ventilation air methane passes through the gas-drainage section 5*b*, the ventilation air methane will pump out the gas in the goaf 6 near the first mine gallery 1, preventing the gas from accumulating in the side of the goaf 6 near the first mine gallery 1.

Step 6

Repeating steps 4-5 sequentially to carry out stoping and alternating intake and air return on sections 3-17 among the 17 sections until the entire stoping area is mined.

In steps 4-6, the mined coal is transported out from the first mine gallery 1 and the first uphill roadway 8.

Based on this embodiment, the gas management mechanism of the present disclosure is explained as follows.

According to the drilling footage of 800 mm per cut of coal, 4 cuts of coal are made per day. Thus, the drilling footage per day is 3.2 m. The stoping of each section needs to be performed for 10 days. When the stoping of the section 1 is performed, the gas in the goaf 6 near the gas-drainage section 5*b* of the second mine gallery 2 will be extracted out. 10 days of continuous pumping can pump out enough gas, so that all the gas in the goaf 6 near the gas-drainage section 5*b* of the second mine gallery 2 will be nearly extracted out. When the section 2 is stoped, the gas in the goaf 6 near the gas-drainage section 5*b* of the first mine gallery 1 will be extracted out. 10 days of continuous pumping can pump out enough gas, so that all the gas in the goaf 6 near the gas-drainage section 5*b* of the first mine gallery 1 will be nearly extracted out. At this time, the gas in the goaf 6 near the gas-drainage section 5*b* of the second mine gallery 2 is gathered again. Because the gas in the goaf 6 near the gas-drainage section 5*b* of the section 1 has already pumped out, so even if the conventional section 5*a* of the section 2 produces a certain fissure, there will not be a large amount of gas influx which will not contaminate the fresh air, the same below. The gas in the goaf 6 near the gas-drainage section 5*b* of the second mine gallery 2 is gathered again and then will be pumped out in the stoping of the section 3. At this time, the gas in the goaf 6 near the gas-drainage section 5*b* of the first mine gallery 1 will be gathered again and then will be extracted in stoping of the section 4, and so on.

As for the goaf 6 of the distal section (i.e., the section where the stoping has not yet been performed) of the mine gallery, due to grouting reinforcement of the coal pillars 5 and the thick concrete on the coal wall side of the coal pillars 5, the isolation effect is good. The gas in the goaf 6 will not enter the mine gallery from the coal pillars 5. The coal pillar 5 near the coal mining area will be affected by coal mining in the coal mining area, which will produce fissures and cause the gas in the goaf 6 to be easy to accumulate and enter the mine gallery. The gas in the goaf 6 will move to the area with low wind pressure. After drilling the gas-drainage hole 5*c*, the prevention of the gas in the goaf 6 from entering the mine gallery can be changed to active management of the gas, which on the one hand, can solve the problem of the gas at source, and on the other hand, can be recycled and used for power generation.

What is claimed is:

1. A ventilation method for a gas-containing working face based on alternating intake and air return in a mine gallery, comprising:

(a) tunnelling a first mine gallery at a dip-direction lower side of an isolated island working face along a strike direction; leaving a first coal pillar between the isolated island working face and a first goaf; and reinforcing the first coal pillar by grouting and concrete pouring; and tunnelling a second mine gallery at a dip-direction upper side of the isolated island working face along the strike direction; leaving a second coal pillar between the isolated island working face and a second goaf; and reinforcing the second coal pillar by grouting and concrete pouring;

(b) making an open-off cut to communicate the first mine gallery with the second mine gallery; and deploying a coal mining device in the open-off cut;

(c) dividing the isolated island working face into N sections from the open-off cut along the strike direction, wherein the N sections are sequentially numbered as 1, 2, . . . , and N; dividing the first coal pillar into a plurality of first conventional sections and a plurality of first gas-drainage sections; and dividing the second coal pillar into a plurality of second gas-drainage sections and a plurality of second conventional sections; wherein the plurality of first conventional sections and the plurality of first gas-drainage sections are alternately arranged; the plurality of second conventional sections and the plurality of second gas-drainage sections are alternately arranged; the plurality of first conventional sections are respectively opposite to the plurality of second gas-drainage sections; and the plurality of first gas-drainage sections are respectively opposite to the plurality of second conventional sections;

(d) within a section 1 among the N sections, drilling a first gas-drainage hole in a gas-drainage section of the second mine gallery, wherein the first gas-drainage hole is communicated with the second goaf; and performing stoping at the section 1; and feeding a first fresh air into a coal mining area through the first mine gallery to form a first ventilation air methane (VAM) which is discharged through the second mine gallery;

(e) within a section 2 among the N sections, drilling a second gas-drainage hole in a gas-drainage section of the first mine gallery, wherein the second gas-drainage hole is communicated with the first goaf; and performing stoping at the section 2; and feeding a second fresh air into the coal mining area through the second mine gallery to form a second VAM which is discharged through the first mine gallery; and (f) sequentially carrying out stoping and alternating intake and air return on sections 3-N among the N sections, wherein the stoping and the alternating intake and air return for odd-numbered sections are performed according to step (d); and the stoping and the alternating intake and air return for even-numbered sections are performed according to step (e).

2. The ventilation method of claim 1, wherein in step (a), the first mine gallery is communicated with a first uphill roadway; and the second mine gallery is communicated with a second uphill roadway.

3. The ventilation method of claim 2, wherein in step (a), at a lower side of the first mine gallery, a first air door is provided on the first uphill roadway, and a second air door is provided on the second uphill roadway; and at an upper side of the second mine gallery, a third air door is provided on the first uphill roadway, and a fourth air door is provided on the second uphill roadway.

4. The ventilation method of claim 3, wherein in step (d), the first air door and the fourth air door are opened, and the third air door and the second air door are closed.

5. The ventilation method of claim 3, wherein in step (e), the third air door and the second air door are opened, and the first air door and the fourth air door are closed.

6. The ventilation method of claim 4, wherein in step (e), the third air door and the second air door are opened, and the first air door and the fourth air door are closed.

7. The ventilation method of claim 1, wherein in step (d), the first gas-drainage hole is drilled in two rows, and two rows of first gas-drainage holes are located at an upper part of the second mine gallery; and in step (e), the second gas-drainage hole is drilled in two rows, and two rows of second gas-drainage holes are located at an upper part of the first mine gallery.

* * * * *